United States Patent [19]

Leshik

[11] Patent Number: 4,501,422

[45] Date of Patent: Feb. 26, 1985

[54] APPARATUS FOR PLAYING A GAME OF SKILL

[76] Inventor: Edward A. Leshik, 122, Princess Ct., Queensway, London, England

[21] Appl. No.: 446,147

[22] Filed: Dec. 2, 1982

[30] Foreign Application Priority Data

Dec. 2, 1981 [GB] United Kingdom ..... 8136329

[51] Int. Cl.[3] ..... A63B 71/06

[52] U.S. Cl. ..... 273/1 GC; 273/1 E; 273/138 A; 434/128

[58] Field of Search ..... 273/237, 238, 1 GC, 273/1 E, 85 G, 138 A, 313, 143 R; 434/128

[56] References Cited

U.S. PATENT DOCUMENTS

| | | | |
|---|---|---|---|
| 2,781,949 | 2/1957 | Stoneburner | 273/143 R |
| 3,129,004 | 4/1964 | Ritzler | 273/143 R |
| 3,503,608 | 3/1970 | Ylinen | 273/1 GC |
| 3,770,269 | 11/1973 | Elder | 273/138 A |
| 3,852,576 | 12/1974 | Rudd | 273/138 A |
| 4,015,846 | 4/1977 | Runte et al. | 273/DIG. 28 |
| 4,060,242 | 11/1977 | Huang et al. | 273/1 GC |
| 4,215,861 | 8/1980 | Nemeth | 273/85 G |
| 4,261,563 | 4/1981 | Goldfarb | 273/1 GC |
| 4,285,517 | 8/1981 | Morrison | 273/1 GC |
| 4,298,198 | 11/1981 | Huang et al. | 273/1 GC |

FOREIGN PATENT DOCUMENTS

| | | | |
|---|---|---|---|
| 2078117 | 1/1982 | United Kingdom | 273/313 |

OTHER PUBLICATIONS

*Popular Electronics;* Jun. 1977, pp. 50–52.

*Primary Examiner*—Richard C. Pinkham
*Assistant Examiner*—Leo P. Picard
*Attorney, Agent, or Firm*—Pollock, Vande Sande & Priddy

[57] ABSTRACT

An apparatus is provided for playing a game in combination with a dispensing machine, such as a beer pump (2). The apparatus comprises two or more columns (4, 5) of lights with the lights in each column being illuminated one at a time cyclically when the beer pump is operated. A switch (3) is provided for use by a player to try to stop cycling with the illuminated lights in a winning position.

5 Claims, 1 Drawing Figure

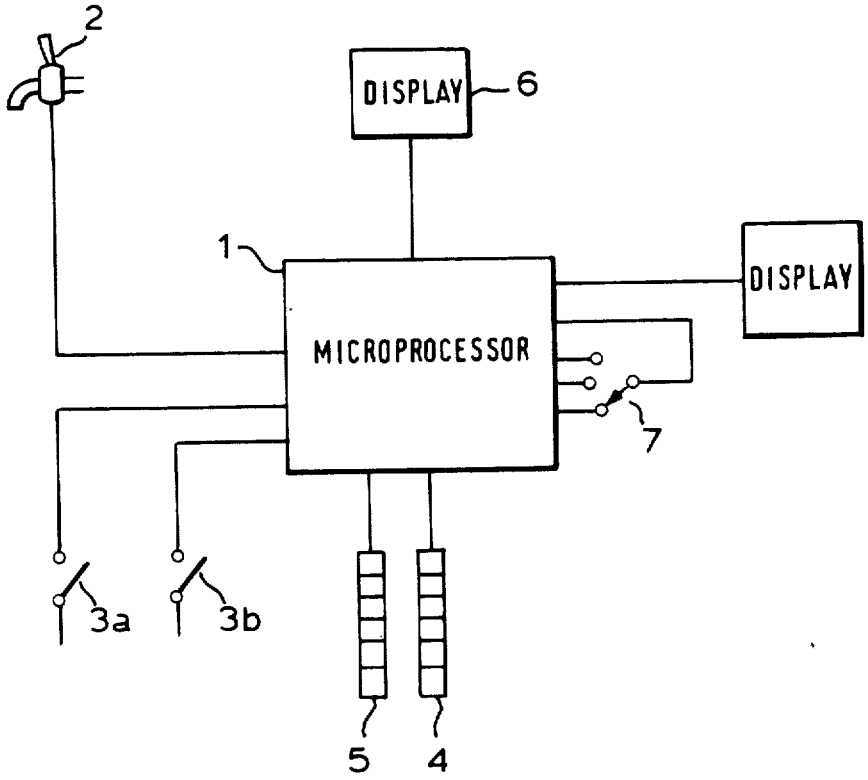
2
DISPLAY
6
1
DISPLAY
MICROPROCESSOR
7
3a
3b
5
4

APPARATUS FOR PLAYING A GAME OF SKILL

This invention relates to games of skill.

According to the invention there is provided apparatus for playing a game, comprising an arrangement of two or more outputs or groups of outputs for emitting signals and capable at any one time of emitting one and only one such signal from a group of possible signals, means for causing the outputs or groups of outputs to run cyclically through their range of signals, and separately controllable means for starting and stopping the cycling of the outputs.

It is preferred that the signals from the outputs be lights, but it will be appreciated that other forms of signals such as different audible frequencies could be used. It is envisaged that, where there are sets of outputs, these could be provided by columns or other arrangements of lights which could be successively illuminated.

It is envisaged that in one embodiment of the invention, the apparatus will be provided for playing what may be termed a BAR TOP game. For instance, two rows of lights could be started to cycle upon commencement of the drawing of a glass of beer by manual or automatic dispensing equipment. Cycling of columns would continue for a limited time and the customer would be provided with two switches so that he could try to stop the cycling of the columns in coincidence with a win frame position. A suitable prize would be provided, e.g. in the form of free beer or a token to be spent in the establishment.

Illumination would continue for a preset time only during which the customer must take this opportunity of trying for correspondence. Once his time has elapsed the illumination would cease. If he was successful in achieving correspondence in the win position, a success signal would be produced on a suitable additional output from the microprocessor leaving the winning positions illuminated and providing a light and/or audible signal for the bar staff signalling that a win has been achieved. A switch is provided for bar staff to acknowledge this win and reset the game for the next play.

The apparatus may be used with any type of dispensing machine, for instance for dispensing drinks.

The lights may be used to backlight separately light tight frames so that only one frame is illuminated at any one time in each column. The graphic material to be illuminated may be in the form of a photographic transparency or silk screened on the underside of a plastic panel.

By use of a 'neutral' acrylic panel the nonilluminated frames may be blacked out and only the illuminated frames show up the graphic material thus lending to a pleasant aesthetic surprise effect.

Provision is made for the equipment to store data relating to the number of plays and number of wins achieved. This information may be read out on request by bar staff for accounting purposes.

The level of difficulty of the game may be influenced by changing the rate of cycling of the outputs and may be preset by operating a multiposition switch. The current difficulty level of the game may be displayed for the information of the customer.

The invention will be further described, by way of example, with reference to the accompanying drawing, which illustrates diagramatically a preferred embodiment of the invention.

The apparatus shown in the accompanying drawing comprises a microprocessor 1 having a first input connected to a switch forming part of a beer-dispensing tap 2. Second and third inputs of the microprocessor are connected to manually actuable switches 3*a* and 3*b*. The microprocessor 1 has outputs connected to a pair of columns 4 and 5, each comprising six individual lights.

The microprocessor has another output connected to a display 6 for displaying information concerning the number of wins and plays, together with the time and data relevant thereto.

The further inputs of the microprocessor are connected to a switch 7 for selecting the level of difficulty of the game. A second display 8 is connected to the microprocessor so as to indicate the current level of difficulty of the game.

In use, the apparatus shown in the drawing is arranged, for instance, on the top of a bar in a public house, restaurant, gafe, club, or the like. The Switches 3*a* and 3*b* are made accessible to customers and the displays 4 and 5 are arranged to be visible to customers. The microprocessor 1 is arranged, upon actuation of the switch in the beer-dispensing pump 2 caused by commencement of drawing a glass of beer, to cycle through illumination of the lights of the columns 4 and 5 so that one light at the time is illuminated in each column and the light which is illuminated scrolls upwardly or downwardly. The scrolling may be in the same direction or in different directions for the two columns 4 and 5.

The microprocessor 1 is arranged to continue scrolling of the displays 4 and 5 until a customer operates the corresponding switches 3*a* and 3*b* to stop the scrolling. The aim of the customer is to stop the scrolling when lights in the columns 4 and 5 are illuminated at predetermined winning positions. However, if the switches 3*a* and 3*b* are not actuated within a predetermined time from the commencement of scolling, the microprocessor 1 automatically stops scrolling and deactivates all the lights in the column 4 and 5. If the customer actuates the switches 3*a* and 3*b* and achieves the object of stopping scrolling with lights illuminated in the two columns in the winning positions then an audible or visible indication is provided by means (not shown) connected to the microprocessor 1 so as to alert the attention of the vendor so that a prize may be given. For instance, the prize may comprise making a free gift of the glass of beer which has just been poured.

The switch 7 is provided so as to allow the level of difficulty of the game to be adjusted by selecting different rates of scrolling for the columns 4 and 5. An indication of the degree of difficulty is provided on the display 8 for the customer. The microprocessor is further arranged to keep a record of the number of wins and plays and may, for instance, store within its memory the sum of the number of games and the sum of the number of wins for each period of, for instance, fifteen minutes. The microprocessor also stores the time and date corresponding to each interval as part of this record, and can be actuated to display this information on the display 6. Alternatively or additionally, the microprocessor 1 may be arranged to make this information available via a connector to external apparatus for processing the record.

Although the apparatus has been described for use with a beer-dispensing pump, it may be used with other liquid dispensing equipment. For instance, electric "optics" or spirit-dispensing measures of the type providing an output signal when spirit is dispensed into a glass may be used to control the commencement of scrolling by the microprocessor 1. Alternatively, "soft" or non-alcoholic drink dispensing machines, for instance of the coin operated variety, may also be used to actuate scrolling, and the apparatus may be built into such dispensing machines.

The microprocessor 1 is preferably also arranged to control the degree of difficulty of the game by adjusting the rate of scrolling of the displays 4 and 5 in response to the cumulative ratio between the number of plays and the number of wins so as to stabilize this ratio over a reasonable period of time.

I claim:

1. An apparatus for playing a game and dispensing a liquid comprising:

liquid dispensing means;

two columns of a plurality of lights;

means for sequentially illuminating each of said lights of each column so that only one of said lights is illuminated at one time in response to a dispensing of a liquid, said means for sequentially illuminating including:

a microprocessor which alters the rate of sequential illumination of said lights;

means for setting the rate of sequential illumination whereby said game degree of difficulty is controlled; and means for providing a visual indication of said degree of difficulty;

manually operable means for terminating said sequential illuminations and maintaining illumination of a light illuminated at the time selected by a game participant, whereby said game is played by attempting to inhibit sequential illumination on a preselected light, and said microprocessor records each time said sequential illumination stops on a selected light; and said microprocessor programmed to adjust said degree of difficulty of said game in response to the ratio of game wins to game plays in a direction to stabilize said ratio.

2. An apparatus according to claim 1, wherein operation of said manually operable means causes said sequentially illuminating means to cease sequential illumination of said plurality of lights of one of said columns.

3. An apparatus according to claim 1 wherein said sequentially illuminating means causes sequential illumination of said columns at different rates.

4. An apparatus according to claim 1 wherein said microprocessor stores a record of the number of game plays and the number of game wins.

5. A game apparatus for initiating a game play in response to the actuation of a liquid dispenser comprising:

first and second columns of lights, each light of said column being separately illuminated in a sequence with the remaining lights;

activation means connected to said liquid dispenser for signalling the actuation of said liquid dispenser;

first and second game player actuable switches;

microprocessor means connected to receive a game initiating signal from said activation means and connected to sequentially illuminate each of said lights in said columns in a sequence, said microprocessor also connected to receive first and second inhibit signals from said first and second game player actuable switches, whereby said columns of lights are sequentially scanned in response to a dispensing of liquid, and scanning of said columns ceases upon closure of said game player actuable switches, said microprocessor storing a win indication every time said participant inhibits scanning on a preselected light, said microprocessor further changing the rate of said sequential illumination in response to the ratio of number of plays to wins to stabilize said ratio;

means for manually selecting said scanning rate to provide a degree of difficulty for said game; and means for providing a visual indication of said degree of difficulty.

* * * * *